United States Patent [19]

Caro

[11] 4,187,416

[45] Feb. 5, 1980

[54] HIGH POWER RF COAXIAL SWITCH

[75] Inventor: Edward R. Caro, Monterey Park, Calif.

[73] Assignee: The United States of America as represented by the Administrator of the National Aeronautics and Space Administration, Washington, D.C.

[21] Appl. No.: 949,886

[22] Filed: Oct. 10, 1978

Related U.S. Application Data

[63] Continuation of Ser. No. 835,419, Sep. 21, 1977, abandoned.

[51] Int. Cl.[2] ..... H01P 1/10; H01H 13/10

[52] U.S. Cl. ..... 200/153 S; 200/304; 333/262

[58] Field of Search ..... 200/153 S, 304, 305; 333/97 S, 262; 335/4, 5

[56] References Cited

U.S. PATENT DOCUMENTS

| | | | |
|---|---|---|---|
| 2,697,767 | 12/1954 | Charles | 200/153 S X |
| 2,826,746 | 3/1958 | Lanctot | 200/153 S X |
| 2,855,471 | 10/1958 | Koontz | 200/153 S X |
| 2,958,053 | 10/1960 | Concelman | 200/153 S X |
| 2,997,669 | 8/1961 | Charles | 200/153 S X |
| 3,087,125 | 4/1963 | Scholfield | 200/153 S X |
| 3,131,268 | 4/1964 | Orner | 200/153 S X |
| 3,227,969 | 1/1966 | Bentley | 200/153 S X |
| 3,374,449 | 3/1968 | Moore et al. | 200/153 S X |
| 3,439,298 | 4/1969 | Steinback | 200/153 S X |
| 3,600,542 | 8/1971 | Richter | 200/153 S X |
| 3,723,692 | 3/1973 | Wilbrecht | 200/304 X |
| 3,739,306 | 6/1973 | Sladek | 200/153 S X |
| 3,993,970 | 11/1976 | Brownell | 333/97 S X |

FOREIGN PATENT DOCUMENTS

| | | | |
|---|---|---|---|
| 715392 | 9/1954 | United Kingdom | 200/153 S |
| 871259 | 6/1961 | United Kingdom | 200/153 S |

*Primary Examiner*—Stephen Marcus
*Attorney, Agent, or Firm*—Monte F. Mott; John R. Manning; Paul F. McCaul

[57] ABSTRACT

A coaxial switch capable of operating in a vacuum with high RF power in the 1.2 GHz range without "multipactor" breakdown, and without relying on pressurization with an inert gas, which requires a hermetic seal, is achieved by completely surrounding the RF carrying conductors of the switch with a high grade solid dielectric, thus eliminating any gaps in which electrons can accelerate.

11 Claims, 6 Drawing Figures

HIGH POWER RF COAXIAL SWITCH

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; USC 2457).

This is a continuation, of application Ser. No. 835,419, filed Sept. 21, 1977, now abandoned.

BACKGROUND OF THE INVENTION

This invention relates to a high-power RF transmission line switch, and more particularly to a single-pole, double-throw (SPDT) switch.

Many applications require a high power RF (e.g., 1.2 GHz) switch having low volume and high power (0.5 to 5 kW) handling capability under vacuum or near vacuum conditions. Space missions are typical applications. For example, assume a spacecraft is to be equipped with a synthetic aperture radar transmitter for wave height or surface roughness measurements, as described in a copending application Ser. No. 744,577 filed by the Administrator of the National Aeronautics and Space Administration in respect to an invention of Atul Jain. Further assume the radar transmitter is to operate with an output power of 800 watts peak with redundance in the output power amplifiers in case of power amplifier failure. Output amplifier selection may then be accomplished with coaxial SPDT switch.

Commercially available coaxial SPDT switches provide a hermetically-sealed enclosure for the switch contacts in order to fill space around the contacts with an inert gas, such as $N_2$. However, these switches have been found to fail during high power test operation in a vacuum, which indicates that these switches would very likely fail in space. The reason for the failure is that the hermetic seals are designed for operation in the earth's atmosphere where the pressure outside the enclosure is very nearly the same as the inert gas inside. With a very low pressure or vacuum outside, the switch enclosure tends to leak. Once all or most of the inert gas escapes, the high power RF being switched will cause the contacts to be subject to multipactor breakdown, a phenomenon to be described hereinafter. That breakdown will cause the contacts to erode. What would be required is a new enclosure design in which loss of the hermetic seal leading to insulation breakdown at critically low pressure will not occur. However, because of the inherent unreliability of hermetic seals of even the most elaborate designs, it would be preferable to use a vented enclosure for a switch that is otherwise designed to withstand power levels up to 5 kW under vacuum conditions without multipactor breakdown followed by ionization.

"Multipactor breakdown" is an electron resonance phenomenon which can only take place in a vacuum, and is dependent upon the RF frequency and conductor spacing. The mechanism of the phenomenon is the release of an electron into the vacuum space due to the potential gradient between the conductors first in one direction and then, as the RF signal changes polarity, in the other direction. When the spacing and frequency are complementary the electron resonance phenomenon develops very quickly. The electron density in the space has to be low in order for the electrons to accelerate to sufficient velocities (without collision) to cause secondary emission, but a vacuum assures that condition so multipactor breakdown occurs, and once it does occur, ionization breakdown follows.

SUMMARY OF THE INVENTION

In accordance with the present invention the RF switch conductors in a metal enclosure are completely surrounded with a solid dielectric, thus eliminating any space in which electrons can accelerate and collide with the enclosure to cause secondary emission. Two movable elongated bar contacts are alternately brought in contact with the center conductors of coaxial connectors attached to the metal enclosure in a line such that the center conductors are parallel and spaced with the centers of one pair slightly greater than the length of one bar and the centers of the other pair slightly greater than the length of the other bar, such that with one bar or the other in contact with its associated pair of conductors, the center conductor in the middle is connected through the contact bar to one or the other of the center conductors. The solid dielectric is E-shaped with each of the three parallel legs surrounding the center conductors of the coaxial cables. The main body portion supporting the three parallel legs is hollowed to provide a space for the contact bars to be moved selectively into and out of contact with the coaxial center conductors. Two transverse holes are provided through the side wall of the main body portion of the dielectric, with their axes normal to the axis of the coaxial center conductors, to receive means which, in response to means for driving the plungers in and out, will cause the connecting bars to move alternately against the coaxial center conductors against the force of biasing springs. The enclosure includes a metal block to which coaxial connector fittings are secured on one side, and through which the legs of the E-shaped dielectric pass from the other side into the coaxial connector fittings. The main body of the E-shaped dielectric is recessed into the block. Two sets of intersecting holes pass through the block. A large diameter hole of each set passes through the block with its axis parallel to the legs of the E-shaped dielectric, and a small diameter hole passes through the block with its axis intersecting the axis of the large diameter hole. These holes are to accommodate the driving means for the bars. The small diameter hole receives a dielectric cylinder that bears against a contact bar and a coil spring. A dielectric plunger extends from the bar into the large diameter hole. A solenoid-actuated lever extends into the large diameter hole to press against the plunger and drive the bar against the force of the spring and into contact with a pair of the coaxial center conductors. A plate over the recessed E-shaped dielectric holds the latter in the metal block. The two solenoids for the two plunger levers may be mounted on that plate, and a cover over the solenoids may be secured to the block.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
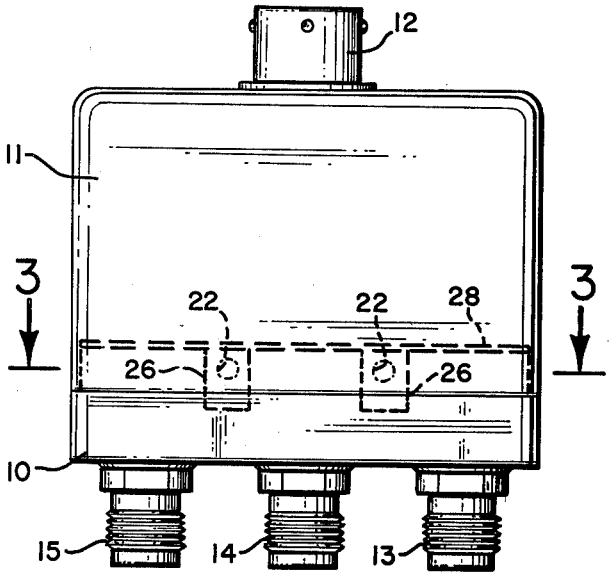
FIG. 1 is a front view of a SPDT switch embodying the present invention.
Figure 2:
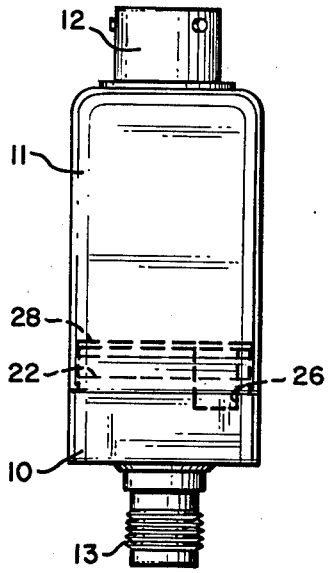
FIG. 2 is a side view of FIG. 1.
Figure 3:
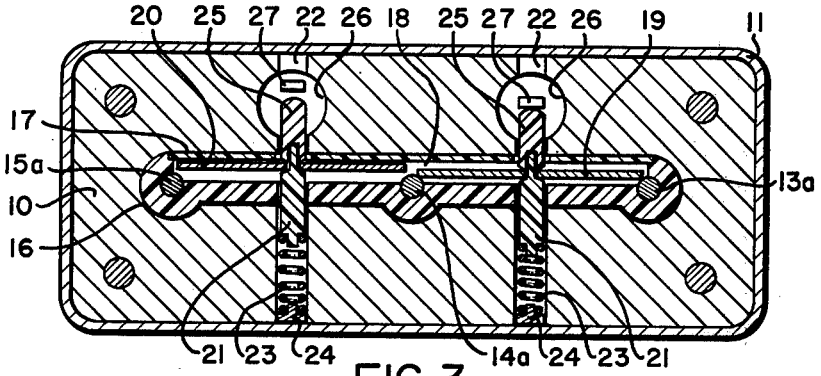
FIG. 3 is a section along a line 3—3 in FIG. 1.
Figure 4:
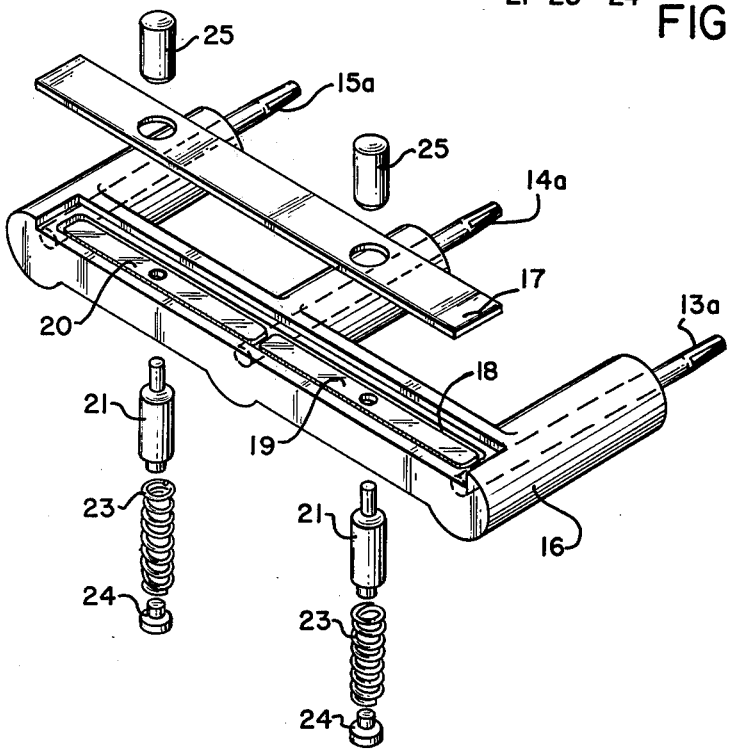
FIG. 4 is an isometric view of an E-shaped dielectric insert for the SPDT switch of FIG. 1 according to the present invention.

Referring first to FIGS. 1, 2 and 3 there is shown in front and side views an assembled SPDT switch comprised of a block 10 that is recessed in its upper half to receive a cover 11 having a connector 12 on top for control leads. The block supports three outer conductors 13, 14 and 15 for coaxial connectors. These outer conductors are preferably threaded into the block 10 in a conventional manner. The inner conductors of the coaxial connectors are pins 13*a*, 14*a* and 15*a* which are held centered in the outer conductors by an E-shaped solid dielectric form 16 the main body portion of which is shown in FIG. 3. The entire E-shaped form is shown in an isometric view in FIG. 4 with recessed side plate 17 removed to reveal that it is hollowed to provide a channel 18 that exposes the upper ends of the inner conductors of the coaxial connectors.

Figure 5:
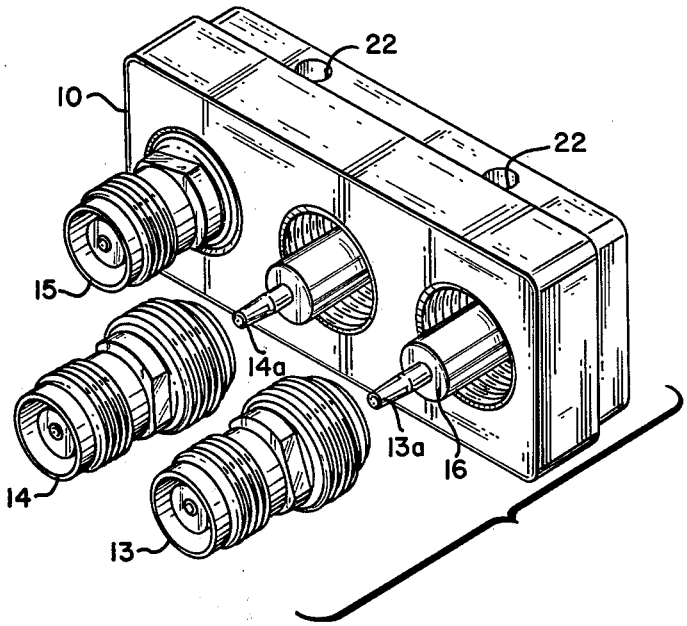
FIG. 5 is an isometric bottom view of a base block for the SPDT switch of FIG. 1.

The E-shaped form is placed into the block 10 with its legs passing through holes in the block into the outer conductors 13, 14 and 15 so that the inner conductors 13*a*, 13*b* and 13*c* are centered in the outer conductors (to complete the coaxial connectors) as shown in FIG. 5. But first, switch contact bars 19 and 20 (FIG. 3) are inserted into the channel 18, one bar reaching across from center conductor 13*a* to 14*a*, and the other bar reaching across from center conductor 14*a* to 15*a*. The side plate 17 is placed over the channel 18 in a recessed position. Once the contact bars and side plate thus assembled are inserted into the block 10, the center conductors (13*a*, 14*a* and 15*a*) and the connector bars (19 and 20) are insulated from the inner conductors by solid dielectric material on all sides. A high grade solid dielectric, such as teflon, is preferred. Except for this feature of surrounding the RF carrying conductors of the switch with solid dielectric material, thus eliminating any gaps in which electrons can accelerate, the SPDT switch thus far described and to be further described is very similar in arrangement and operation to a commercially available SPDT switch manufactured by Transco Products, Inc. of Venice, Calif. The presence of the dielectric material eliminates the need of a hermetic seal for an inert gas surrounding the RF carrying conductors. To switch the center conductor 13*b* in the middle to an RF source connected to either the center conductor 13*a* or the center conductor 13*c*, it is merely necessary to press the contact bar 19 or 20 against the center conductors. Both bars are spring-biased in a position away from those center conductors.

To spring bias each of the contact bars 19 and 20 away from the center conductors of the coaxial connectors, a dielectric cylinder 21 is inserted into a transverse hole 22 of small diameter, as shown in FIG. 3. That hole is normal to the bar and the center conductors of the coaxial connectors. The cylinder extends into the channel of the main body of the E-shaped form and bears against the bar. A coiled spring 23 is inserted into the hole behind the cylinder 21, and a plug 24 is press fitted, or threaded, into the hole behind the spring.

To drive each of the contact bars against the force of the bias spring into contact with the inner conductors of the coaxial connectors, a plunger 25 is inserted into the hole 22. That plunger is a dielectric and is long enough to protrude into a hole 26, which hole is of larger diameter and normal to the hole 22 as shown, even while the plunger is forced in against the spring 23 to close contact between the bar and center conductors of the coaxial connectors. To operate the SPDT switch, it is thus necessary to simply reach into the large diameter holes with relay-actuated levers 27 and alternately force one plunger in while releasing the other. The bar of the plunger released is forced away from the center conductors by the force of the spring 23. In that manner the switching bars and center conductors of the coaxial connectors are surrounded with the solid dielectric material of the E-shaped form, cylinders 21 and plungers 25.

Figure 6:
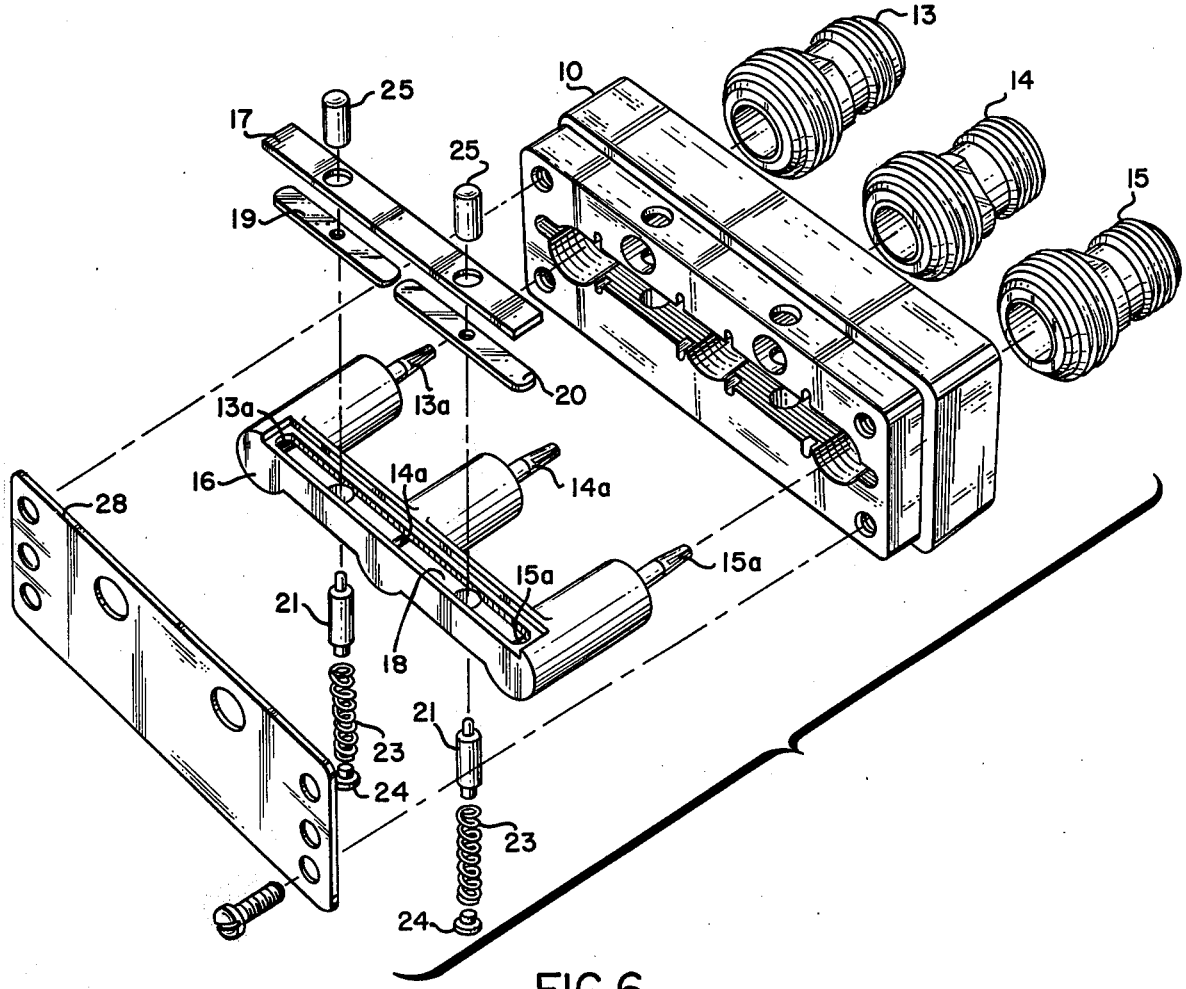
FIG. 6 is an exploded isometric view of the parts of the SPDT switch of FIG. 1.

The relays for the actuating levers 27 which push on the plungers 25 are preferably of the magnet-latching type, and may be the same as the relays used in the SPDT switch manufactured by Transco Products, Inc. Those relays are secured to a plate 28 (FIG. 6) which holds the E-shaped form 16 in the block 10. The cover 11 protects the relays and the connector 12 provides the necessary connections to the relays for their control by external signals.

Although particular embodiments of the invention have been described and illustrated herein, it is recognized that modifications and equivalents may readily occur to those skilled in the art and consequently it is intended that the claims be interpreted to cover such modifications and equivalents.

What is claimed is:

1. A coaxial switch comprising RF switch conductors, a metal enclosure for said switch conductors, and a solid dielectric completely surrounding said conductors within said metal enclosure, said dielectric electrically isolating said conductors and said metal enclosure to eliminate any space through which electrons may be accelerated to cause secondary emission by collision with said metal enclosure, wherein said switch is for connecting the center conductors of coaxial connectors having their outer conductors connected to said metal enclosure, said switch being comprised of at least two parallel conductors of coaxial connectors, said conductors being center conductors of said coaxial connectors and extending into said enclosure and dielectric, a movable elongated bar across said parallel conductors, an elongated cavity in said dielectric extending across said parallel conductors for said elongated bar to be moved out of contact with said parallel conductors, a transverse hole through said dielectric surrounding said parallel conductors and elongated bar, said transverse hole intersecting said cavity at the center of said bar in a direction normal to said bar and said parallel conductors, a dielectric pushing means in said hole on one side of said bar, spring means biasing said dielectric pushing into said hole against said bar to move said bar away from said conductors, a dielectric plunging means in said hole on a side opposite said pushing means, and means for thrusting said plunging means in said hole into said bar and against said spring means to move said bar against said conductors.

2. A coaxial switch as defined in claim 1 wherein said plunging means is sufficiently long to protrude out of said dielectric surrounding said conductors and bar, and said means for thrusting said plunger into said hole and against said bar is comprised of a relay-actuated lever.

3. A coaxial switch as defined in claim 2 including metal closely surrounding said dielectric for support of said dielectric and conductors, and a second hole through said metal intersecting said transverse hole for receiving said relay-actuated lever in a position for thrusting said plunger into said bar.

4. A coaxial switch as defined in claim 3, including a third coaxial connector having its outer conductor connected to said metal cover, and its center conductor extending into said enclosure and dielectric in a position to one side and parallel to said two parallel conductors, wherein said elongated cavity extends across the center conductor of said third coaxial connector, and including a second elongated bar in said cavity across said center conductor of said third coaxial cable and the adjacent one of said two parallel conductors, a second transverse hole through said dielectric, said second transverse hole intersecting said cavity at the center of said second bar, and normal to said second bar and said parallel conductors, a second dielectric pushing means in said second hole on one side of said second bar, spring means biasing said second cylinder into said second transverse hole against said second bar to move said second bar away from said conductors, a second dielectric plunging means in said second transverse hole on a side opposite said second pushing means, and means for thrusting said second plunging means into said second bar against said spring means to move said second bar against said conductors.

5. A coaxial switch as defined in claim 4 wherein said second plunging means is sufficiently long to protrude out of said dielectric surrounding said conductors and second bar, and said means for thrusting said second plunger into said second bar is comprised of a second relay-actuated lever.

6. A coaxial switch as defined in claim 5 including a hole through said metal intersecting said second transverse hole for receiving said second relay-actuated lever in a position for thrusting said second plunging means into said second bar.

7. A single-pole, double-throw RF coaxial switch comprising three conductors and two contact bars in a metal enclosure, said conductors being completely surrounded by a solid dielectric material between the conductors and the metal enclosure except over a minimal bar contact area, said three conductors being center conductors of coaxial connectors parallel to each other in a common plane, and said two contact bars being closely surrounded by said solid dielectric material having only a minimal space for said bars to move in contact with said conductors, and solid dielectric means passing through said dielectric material for alternately bringing said bars into contact with the middle one of said conductors and one of the remaining two conductors such that with one contact bar or the other in contact with the middle conductor and one or the other of the remaining two conductors, the middle conductor is connected through the contact bar to one or the other of the conductors.

8. A single-pole, double-throw RF coaxial connector as defined in claim 7 wherein said solid dielectric material is E-shaped with each of the three parallel legs surrounding and supporting the center conductors of said coaxial connectors, and with the main body portion thereof supporting said legs having a hollow cavity extending across the base of said three legs to expose the conductors supported by the legs and to provide space for said bars to be brought alternately into and out of contact with said conductors.

9. A single-pole, double-throw RF coaxial connector as defined in claim 8 wherein said means solid dielectric for alternately bringing said bars into contact with said conductors is comprised of two transverse holes through said main body portion, each hole having its axis normal to and through the center of a contact bar and a dielectric cylinder in each hole against a contact bar on the same side of the bar as conductors contacted by the bar, spring means forcing said cylinder against the bar to hold it out of contact with the conductors, each hole further having a plunger dielectric against a contact bar on the opposite side of the bar as conductors contacted by the bar, whereby said plungers may be driven against said contact bars to force said contact bars against said conductors.

10. A single-pole, double-throw RF coaxial switch as defined in claim 9 wherein said metal enclosure and main body portion of dielectric material have two pair of aligned holes, each intersecting one of said transverse holes on the one side of a contact bar having a plunger, and a separate lever passing through each pair of aligned holes for driving said plungers against said contact bars.

11. A single-pole, double-throw RF coaxial switch as defined in claim 10 wherein said metal enclosure is comprised of a metal block having three holes for the legs of said E-shaped dielectric material, and a cavity for the main body of said E-shaped dielectric material to be recessed into said block, and a metal plate over said recessed main body.

* * * * *